US005670943A

United States Patent [19]

DiPoala et al.

[11] Patent Number: 5,670,943

[45] Date of Patent: Sep. 23, 1997

[54] PET IMMUNE INTRUDER DETECTION

[75] Inventors: William S. DiPoala, Fairport, N.Y.; Lawrence R. Tracy, Auburn, Calif.

[73] Assignee: Detection Systems, Inc., Fairport, N.Y.

[21] Appl. No.: 630,238

[22] Filed: Apr. 10, 1996

Related U.S. Application Data

[60] Provisional U.S. application No. 60/012,264, Feb. 26, 1996.

[51] Int. Cl.[6] ..... G08B 13/18

[52] U.S. Cl. ..... 340/567; 250/DIG. 1; 250/353

[58] Field of Search ..... 340/555, 567, 340/511; 250/342, DIG. 1, 353

[56] References Cited

U.S. PATENT DOCUMENTS

| | | | |
|---|---|---|---|
| 4,764,755 | 8/1988 | Pedtke et al. | 340/541 |
| 4,841,284 | 6/1989 | Biersdorff | 340/567 |
| 4,849,635 | 7/1989 | Sugimoto | 340/567 |
| 4,868,391 | 9/1989 | Messiou | 250/DIG. 1 |
| 5,276,427 | 1/1994 | Peterson | 340/522 |
| 5,382,944 | 1/1995 | Dipoala et al. | 250/DIG. 1 |
| 5,473,311 | 12/1995 | Hoseit | 340/573 |

*Primary Examiner*—Jeffery Hofsass
*Assistant Examiner*—Anh La
*Attorney, Agent, or Firm*—J. Addison Mathews

[57] ABSTRACT

A passive infra-red, pet immune intruder detector includes upper and lower fields-of-view or zones. The detector is less sensitive to infra-red targets in the lower zones, compared to the upper zones, and the alarm threshold is set slightly above the level required to detect humans in the lower zones. Animals, which do not have access to the upper more sensitive zones are not detected in the lower relatively insensitive zones. The detector includes pyroelectric sensing elements and multi-faceted optics for directing infra-red energy onto the sensing elements from at least one lower zone, intercepting the floor plane, and at least one upper zone, extending entirely above the floor plane. The facet defining the lower zone focuses infra-red energy onto the sensing elements less efficiently than the facet defining the upper zone.

21 Claims, 5 Drawing Sheets

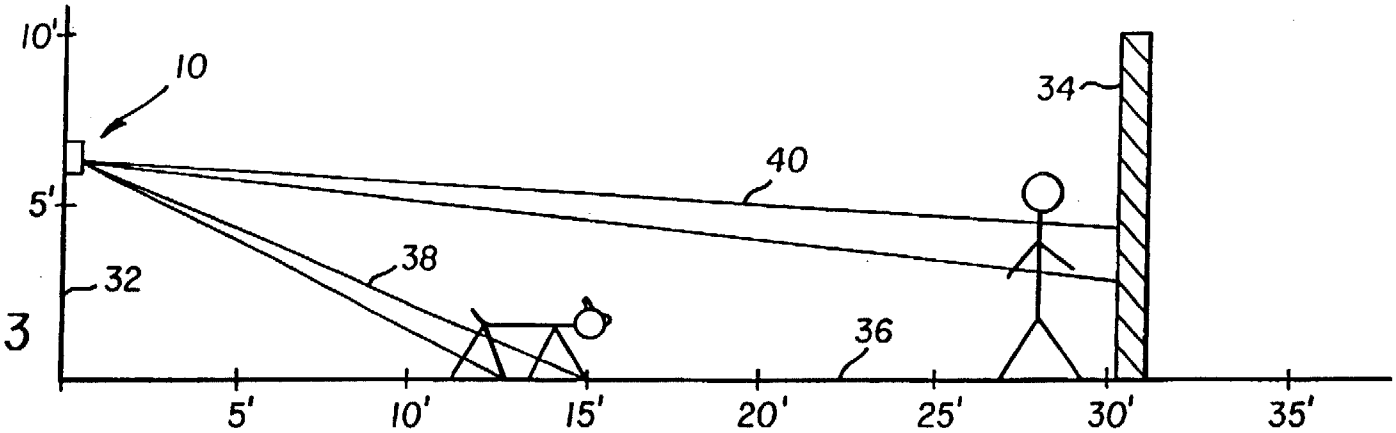
FIG. 3
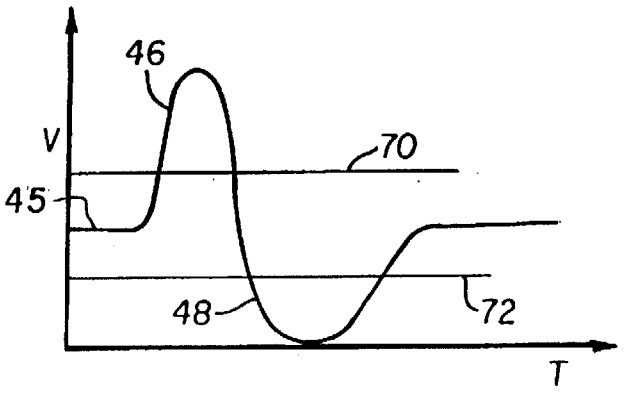
FIG. 4
FIG. 5
FIG. 6

PET IMMUNE INTRUDER DETECTION

CROSS REFERENCE TO RELATED APPLICATIONS

Reference is made to our corresponding provisional application Ser. No. 60/012,264, filed Feb. 26, 1996.

DESCRIPTION

1. Field of Invention

The invention relates to intruder detection using infra-red energy and more specifically to such intruder detection immune to many domestic animals.

2. Background of the Invention

Passive infra-red intruder detectors typically employ one or more pyroelectric sensors that detect movement in a protected region. Optics focus infra-red energy from the region onto the sensors. When a target having a temperature different from the background moves across the optical field-of-view, the sensor responds by producing a electrical signal. The signal is amplified and processed to reject spurious events and reduce false alarms. Signals typical of intruders, on the other hand, are detected and used to initiate an alarm signal that activates an alarm relay.

Detector effectiveness often is improved with optics that include segmented mirrors or lenses having multiple fields-of-view. Movement of an infra-red target into or through any of the fields will produce an electrical signal at the sensor, increasing the probability of detection. A detector mounted six or seven feet high in the corner of a room, for example, might have twenty or more separate fields-of-view, sometimes called zones, covering the room both horizontally and vertically.

Fields-of-view that intercept the floor will detect or "catch" intruders attempting to crawl into the protected region. At the same time, however, they also catch ground based domestic animals, such as dogs and cats. Since household pets are likely to produce false alarms whenever they are active in the protected area, detectors often are disarmed, or the pets are confined to areas not protected by the system. This causes a dilemma in households where pets that might otherwise deter intruders instead reduce system effectiveness.

Pet proof security systems have been addressed in prior art disclosures. Hoseit U.S. Pat. No. 5,473,311, for example, describes a system that relies on: 1) a microwave signal, 2) a high frequency microwave signal, and 3) an infra-red signal, to distinguish pets from human intruders. The signals are combined in a microprocessor according to a relatively complicated algorithm and compared to a predetermined alarm configuration. According to Hoseit, the algorithm is based on the premise that a human intruder generates more infra-red energy, is more massive, and produces a larger Doppler signal. The combination of speed, mass and energy results in a higher alarm configuration for a human intruder than a pet.

Although prior art devices may be satisfactory for their intended purposes, it will become apparent from the following description that existing approaches are unduly complicated for many installations. Doppler detectors are required, along with relatively sophisticated algorithms and signal processing. As the criteria for rejecting pet signals becomes more complex, it increases the probability of a false assumption, permitting undetected access by a real intruder.

SUMMARY OF THE INVENTION

The present invention is directed to improvements in pet immune intruder detectors and to overcoming one or more of the problems set forth above. Briefly summarized, according to one aspect of the invention, a passive infra-red intruder detector includes upper and lower fields-of-view or zones. The detector is less sensitive to infra-red targets in the lower zones, compared to the upper zones, and is set to detect humans in the lower zones, but not household pets such as dogs and cats. Since ground based pets are not normally active in the upper more sensitive zones, they are not detected. Human intruders, on the other hand, are detected in both the lower and upper zones, with added security provided by the likelihood they will be active in the upper more sensitive zones.

According to more specific features, the detector covers a protected region above a floor plane. The detector includes pyroelectric sensing elements and multi-faceted optics for directing infra-red energy onto the sensing elements from at least one lower zone, intercepting the floor plane, and at least one upper zone, extending entirely above the floor plane. The facet defining the lower zone focuses infra-red energy onto the sensing elements less efficiently, resulting in lower sensitivity, than the facet defining the upper zone.

Although not required by all embodiments of the invention, enhanced performance is available when a pet immune infra-red detector, as summarized above, is combined with a microwave detector in a dual technology system. Since Doppler signals vary according to the size of the target, pets will produce a smaller Doppler signal. Thresholds are set for both technologies to improve the rejection of signals resulting from pets without significantly reducing system effectiveness for detecting human intruders. Still other enhancements are available by adjusting the threshold of the infra-red detector as a function of background temperature, increasing sensitivity as the background temperature approaches human body temperature.

Human intruders can be distinguished from pets with only a passive infra-red detector, not requiring dual technologies or microwave energy. Although combinations with microwave detectors may be preferred to enhance performance in certain installations, complex algorithms or signal processing is not required and there is no need to separately process high frequencies in the microwave channel.

These and other features and advantages of the invention will be more clearly understood and appreciated from a review of the following detailed description of the preferred embodiments and appended claims, and by reference to the accompanying drawings.

BRIEF DESCRIPTION OF THE DRAWINGS

FIG. 3 is a schematic representation of the upper and lower fields of view or zones of the detector of FIG. 1.

FIGS. 4–6 are graphs of signals from the detector of FIG. 1 with voltage on the vertical axis and time on the horizontal axis. FIG. 4 represents a human in the lower zone. FIG. 5 represents a human in the upper zone. FIG. 6 represents an animal in the lower zone.

DETAILED DESCRIPTION OF THE INVENTION

Figure 1:
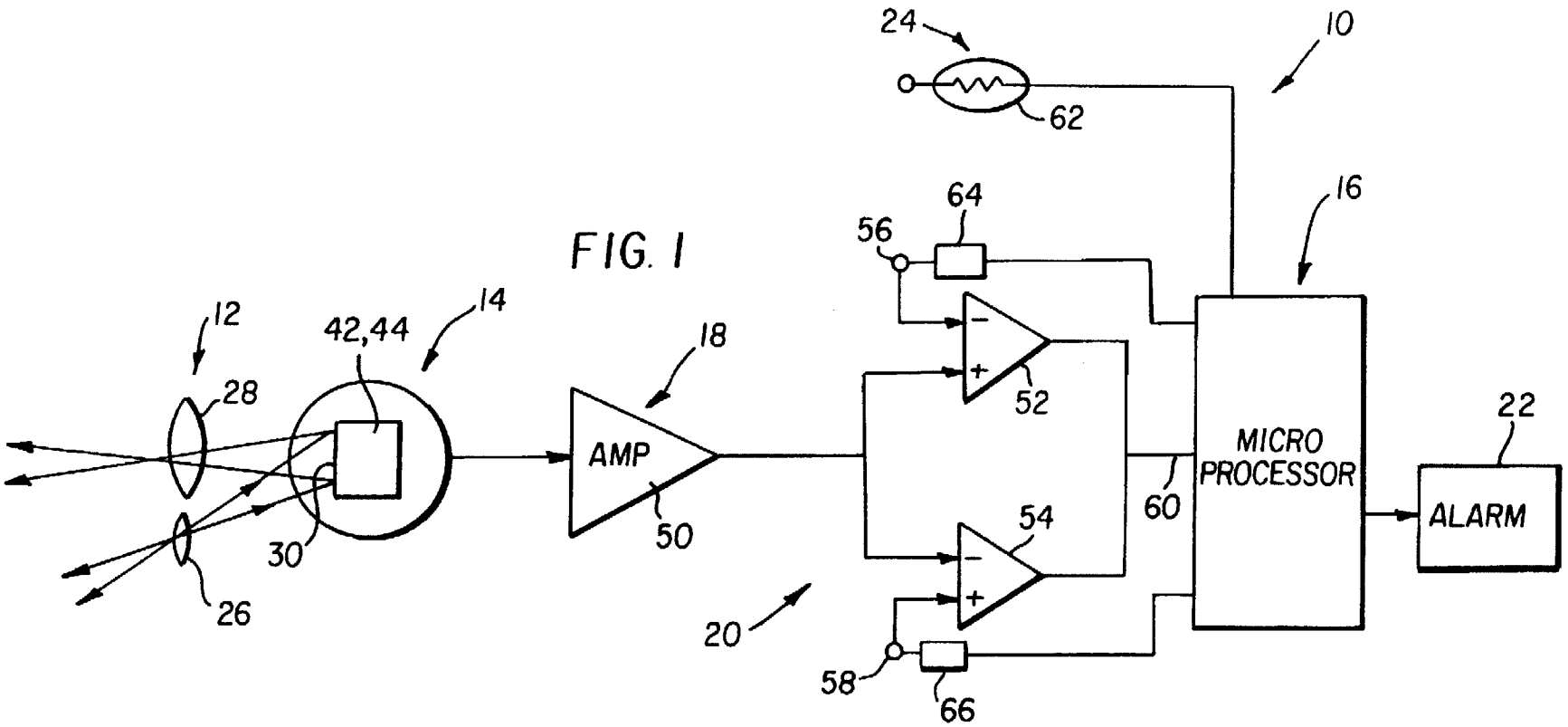
FIG. 1 is a block diagram of an infra-red detector in accordance with a preferred embodiment of the invention. The detector includes an infra-red sensor depicted from one side to show upper and lower fields-of-view or zones.
Figure 2:
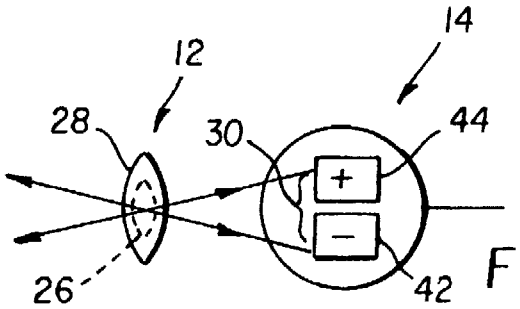
FIG. 2 is a top schematic view depicting the infra-red sensor of FIG. 1.

Referring now to the drawings, and beginning with FIGS. 1–3, a preferred embodiment of the invention is depicted in a passive infra-red intruder detector 10. The intruder detector 10 comprises a multi-lens optical system 12 and infra-red sensor 14, coupled to a microprocessor control 16 through an amplification stage 18 and threshold detecting stage 20. Also coupled to the microprocessor 16 are an alarm or alarm relay 22, and thermistor 24. Although threshold detecting stage 20 is depicted as a circuit separate from the microprocessor 16, to facilitate the description, the comparing function preferably is carried out by the microprocessor under software control.

Multi-lens optical system 12 is depicted in FIGS. 1 and 2 as first and second lens elements 26 and 28, focusing infra-red energy from a protected region onto the sensor 14. Each lens element 26 and 28 defines a discrete field-of-view or zone from which it directs energy onto the same or essentially the same surface area 30 of the sensor 14.

The region protected by the detector 10, also referred to as the region under surveillance, is defined by the effective range of the detector above a floor plane. In FIG. 3, for example, the detector 10 is mounted six or seven feet high in a corner 32 of a room. The effective range is determined by the opposing walls of the room, represented by opposite wall 34. In the vertical direction, the effective range extends to the floor plane, represented at 36 in FIG. 3.

Lens element 26 defines a discrete lower field-of-view or zone 38 that intercepts floor plane 36 within the protected region. Lens element 28, on the other hand, defines an upper field-of-view or zone 40 that extends entirely above the floor plane within the protected region.

For reasons that will be more apparent from the following description, the zone boundaries ideally should separate the protected region into: 1) upper zones normally intercepted by active human occupants, but not ground based pets, and 2) lower zones normally intercepted by both active humans and such pets. Although not precisely differentiated by interception with the floor plane, that is the distinction used for differentiating the upper and lower zones in this preferred embodiment.

Infra-red sensor 14 comprises a pair of closely spaced pyroelectric elements 42 and 44 (FIG. 2) connected in series opposition in a manor well known to those skilled in the art. When an intruder passes through one of the zones, the pyroelectric elements produce a sensor output signal 45 (FIG. 5), comprising a first pulse 46 in one direction, followed by a second pulse 48 in an opposite direction.

The sensor output signal 45 is suitably amplified by a high gain bandpass amplifier 50 (FIG. 1), which filters out frequencies uncharacteristic of intrusion. The amplified output preferably is converted to a digital signal suitable for processing by microprocessor 16, which would compare the signal to appropriate thresholds, and handle other signal processing. To facilitate this description, however, the comparison function is illustrated as a circuit including a pair of differential amplifiers 52 and 54, respectively, which operate as a window comparator. Amplifiers 52 and 54 provide a threshold sensing function, compared to reference voltages 56 and 58, respectively, that rejects outputs not characteristic of an intruder. The output 60 of amplifiers 52 and 54, which also is an input to microprocessor 16, will go positive whenever the output of amplifier 50 exceeds reference 56 in one direction or reference 58 in the other direction.

Figure 10:
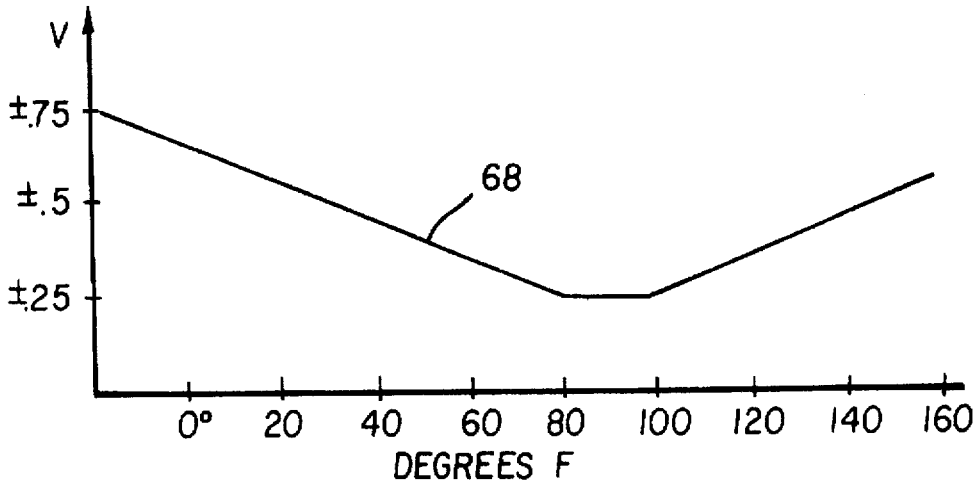
FIG. 10 is a graph depicting detector sensitivity as a function of temperature according to the preferred embodiment.

Although not required for all embodiments of the invention, in the preferred embodiment a thermistor 24, located adjacent the pyroelectric elements 42 and 44, provides an additional input to microprocessor 16. The microprocessor uses the thermistor input to adjust the reference voltages 56 and 58 as a function of ambient temperature in the vicinity of the sensors 42 and 44. The adjustment preferably is accomplished by the microprocessor with software control. Again, however, to facilitate this description, the mechanism for adjusting the reference voltages is illustrated as adjustable voltage sources or dividers 64 and 66, respectively. The voltage sources or dividers 64 and 66 operate under microprocessor control to implement a function, depicted as 68 in FIG. 10, which increases the sensitivity of the detector as ambient or background temperature converges toward human body temperature from either direction.

The term "sensitivity," as used in this specification, refers to the temperature differential required to trigger initiation of an alarm signal. The phrase "temperature differential" refers to the difference between the background temperature in the region under surveillance and the temperature of a target moving in the region through one or more of the detector fields-of-view. Sensitivity increases as the alarm-triggering temperature differential decreases.

The reference thresholds 56 and 58 are selected so a pet in the lower zone 38, such as a dog or cat, will not produce a signal exceeding the reference thresholds. A human intruder in the same lower zone 38, on the other hand, will produce a signal exceeding the threshold. Such an adjustment is possible, we have found, because animals emit less infra-red energy than humans. Although animals may have a higher body temperature, they also have an insulating coat, and the net effect is a lower infra-red signature compared to a clothed human.

FIGS. 4–6 represent the settings mentioned above. The reference thresholds are 70 and 72, respectively corresponding to the voltages 56 and 58 on FIG. 1. Typical threshold values are plus and minus half a volt (±5 v), relative to the quiescent voltage of the comparator. FIG. 4 depicts the signal 74 from a human intruder in the lower zone 38. FIG. 5 depicts the signal 45 from a human intruder in the upper zone 40. FIG. 6 depicts the signal 78 from a pet in the lower zone 38. Although the human signal exceeds the thresholds in either zone, the pet signal does not exceed the signal in the lower zone, and a ground based pet normally is not active in the upper zone.

From empirical data we have determined that a typical dog in an environment at normal room temperature, approximately seventy degrees Fahrenheit, is sensed as a differential temperature or temperature change of approximately five degrees Fahrenheit compared to the background. Long haired dogs are around two degrees Fahrenheit while short haired dogs are around six degrees Fahrenheit. Clothed humans, on the other hand, typically are sensed as a temperature differential or temperature change of approximately ten degrees Fahrenheit, or within a range from approximately eight degrees Fahrenheit to approximately thirteen degrees Fahrenheit, depending on clothing.

Typical infra-red intruder detectors operate at frequencies within the range of one third Hertz to three Hertz, so the noted temperature changes occur within a time period ranging from one third of a second to three seconds. Of course other frequencies and time intervals could be employed.

Recognition of the signal differences between animals and humans might be sufficient to design a detector with a threshold setting that would distinguish between pets and humans. According to the present invention, however, the detector performance is further enhanced by a relative reduction in the sensitivity of the lower zones, that intersect the floor, compared to the upper zones, that extend entirely above the floor. Since household pets, such as dogs and cats, will not normally be present in the upper more sensitive zones, the "catch" performance of the detector is enhanced without sacrificing pet immunity.

In this preferred embodiment, the threshold settings are the same for the upper and lower zones, 56 and 58 (FIG. 1) or 70 or 72 (FIGS. 4–6). The sensitivity difference between the upper and lower zones is provided by an optical system designed to transmit infra-red energy less efficiently in the lower zone compared to the upper zone. Lens 26 (FIG. 1) has a smaller effective aperture or greater effective f-number than lens 28, transmitting less infra-red energy onto the same surface area 30 of pyroelectric elements 42 and 44. Of course filters or focus also could be used to reduce the effectiveness of infra-red transmissions from the lower zone, and the term "effective" is used with aperture or f-number to include these and other equivalent approaches.

Figure 7:
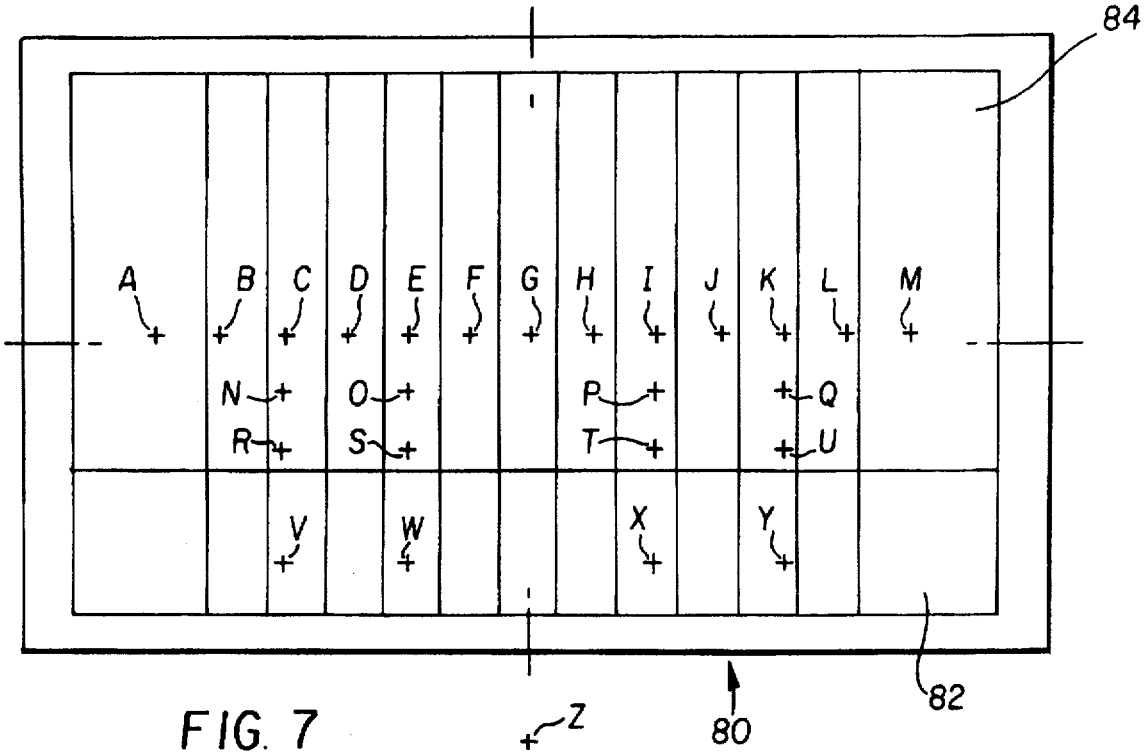
FIG. 7 is a schematic view representing the front face of a multifaceted lens which is part of the detector of FIG. 1.
Figure 8:
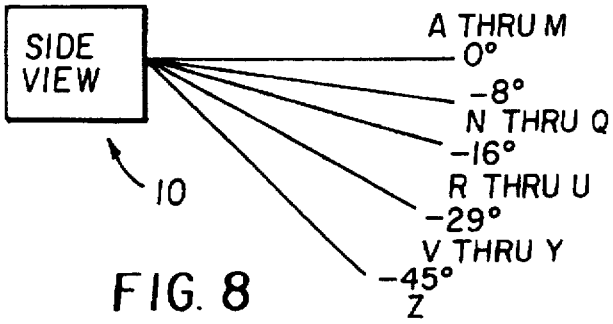
FIG. 8 is a schematic representation depicting multiple fields of view, or zones, defined in a vertical plane by the multifaceted lens of FIG. 7.
Figure 9:
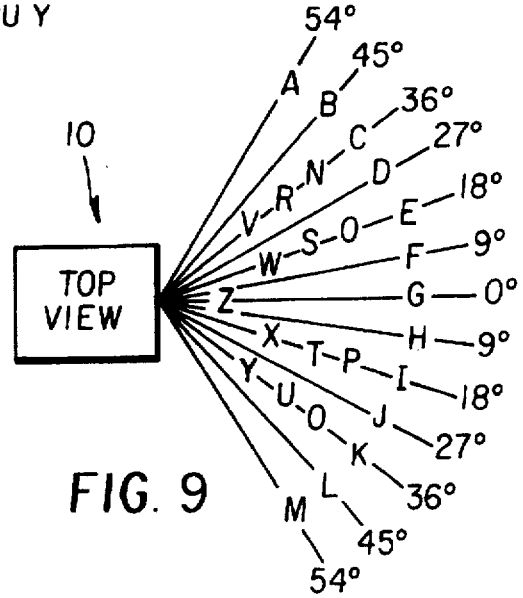
FIG. 9 is a schematic representation depicting multiple fields of view, or zones, defined in a horizontal plane by the multifaceted lens of FIG. 7.

Although FIG. 1 includes lenses 26 and 28 that represent lower and upper zones, FIGS. 7–9 are a more accurate representation of the preferred embodiment. Instead of separate lenses, FIG. 7 depicts a multi-faceted lens 80 having twenty six lenslets A–Z. Each lenslet defines an individual field of view or zone covering the protected area horizontally from side to side and vertically from the horizontal downwardly toward the detector. The upper fields-of-view or zones are approximately one foot wide by one and one half feet high, while the lower fields-of-view or zone are approximately one half of a foot wide and three quarters of a foot high.

Lenslets V–Z are in lower zones 82, and transmit infra-red energy less efficiently than lenslets A–U, which are in upper zones 84. Again, the distinction between the lower and upper zones is based on intersection with the floor plane within the effective range of the detector. Zones V–Z intersect the floor plane while zones A–U extend entirely above the floor plane within the protected region. The relative efficiency of the lenslets in this preferred embodiment are determined by the effective f-number of the respective lenslets as described above in connection with lenses 26 and 28 (FIG. 1).

Figure 11:
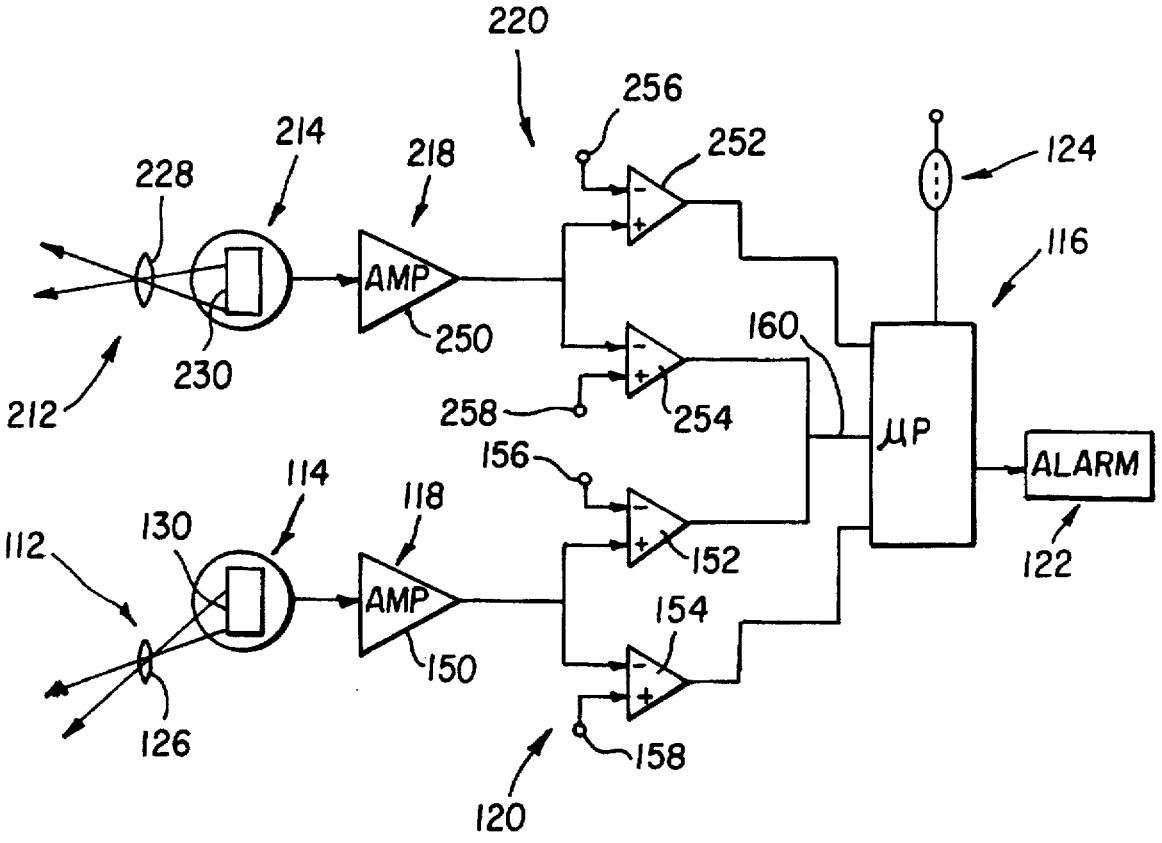
FIG. 11 is a block diagram depicting an alternative embodiment of the invention, similar to the embodiment of FIG. 1, but using separate infra-red sensors in the upper and lower zones.

FIG. 11 depicts an alternative embodiment having separate electrical channels for the upper and lower zones. The components of each channel are essentially the same as the preferred embodiment, and are identified with similar reference numerals plus one hundred in the lower channel and plus two hundred in the upper channel. In this first alternative embodiment, however, the amplifier 150 has a lower gain than amplifier 250, and/or the reference thresholds 156 and 158 have higher absolute levels than reference thresholds 256 and 258. Only one microprocessor, 116, one alarm relay 122 and one thermistor 124 are required. The operation of this first alternative embodiment is similar to the preferred embodiment in that the lower channel has a lower sensitivity, to detect humans but not animals, while the upper channel has a higher sensitivity, to increase the probability that all human intruders will be detected.

Figure 12:
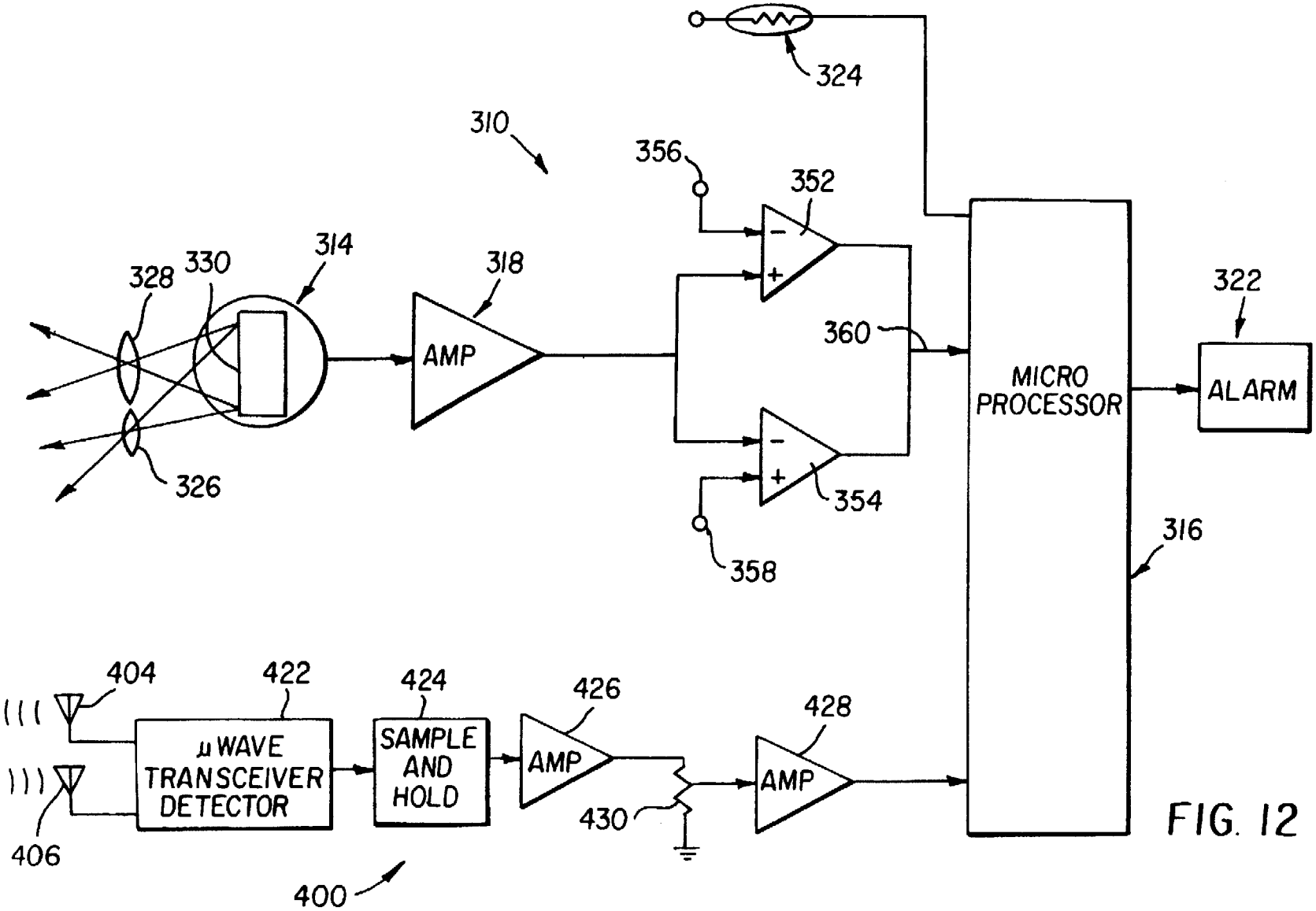
FIG. 12 is a block diagram depicting a second alternative embodiment of the invention including the infrared detector of FIG. 1 combined with a microwave detector.

Still another alternative embodiment is depicted in FIG. 12, including an infra-red detector the same as the detector of FIG. 1, combined with a microwave detector 400. Components of the infra-red channel are identified by the same reference characters as FIG. 1, plus 300. The microwave channel includes a microwave transceiver-detector 422 coupled to transmitting and receiving antennas 404 and 406, respectively. The transceiver-detector 422 produces a Doppler signal in a manner well known for such detectors. The Doppler signal is sampled at 424 and amplified in two stages 426 and 428. Overall gain is adjustable with voltage divider 430. Combined infra-red and microwave detectors, often called dual technology detectors, reduce false alarms because they issue an alarm signal only when both detectors indicate the presence of an intruder. This combination enhances pet immunity, since pets typically are smaller than humans and produce a smaller microwave signal. While combined detectors may enhance performance, it should be apparent that the infra-red channel still operates with a lower effectiveness in lower zones compared to the upper zones and the sensitivity in the lower zones is sufficient to "catch" human intruders without false alarming from pet activity.

In summary, the invention provides an improved pet immune intruder detector that is less sensitive to infra-red energy in lower zones, compared to upper zones. Such dual or multiple sensitivity increases the probability that activity from ground based pets will be rejected while activity from humans will be detected.

Based on an expected background temperature of seventy degrees Fahrenheit, typical sensitivity values, according to the invention, are: a) greater than seven degrees Fahrenheit or within a range of eight to thirteen degrees Fahrenheit in the lower fields-of-view, and b) less than seven degrees Fahrenheit, within a range of one to four degrees Fahrenheit, or approximately two degrees Fahrenheit in the upper field-of-view. Sensitivity adjustments also can be made as the background or ambient temperature changes, and such adjustments preferably maintain the relative sensitivity of the upper field-of-view at least three and preferably five degrees Fahrenheit more sensitive than the lower field-of-view.

Although the invention is described in connection with a preferred embodiment, other modifications and applications will occur to those skilled in the art. The claims should be interpreted to fairly cover all such modifications and applications within the true spirit and scope of the invention.

PARTS LIST

| Reference No. | | Part | |
|---|---|---|---|
| 10. | Passive infra-red intruder detector. | 60. | Amplifier output thermistor. |
| 12. | Optical system. | 62. | |
| 14. | Infra-red sensor. | 64 & 66. | variable voltage source or divider. |
| 16. | Microprocessor. | 68. | Function. |
| 18. | Amplification stage. | 70 & 72. | Reference threshold. |
| 20. | Threshold detection | | |

-continued

PARTS LIST

| Reference No. | Part | Reference No. | Part |
|---|---|---|---|
| | stage. | 74. | Human Signal. |
| 22. | Alarm or relay. | 78. | Pet Signal. |
| 24. | Thermistor. | 80. | Multi-faceted lens. |
| 26. | First lens element. | 82. | Lower zones. |
| 28. | Second lens element. | 84. | Upper zones. |
| 30. | Surface area illuminated by lens elements. | 116. | Microprocessor. |
| | | 122. | Alarm relay. |
| | | 124. | thermistor. |
| 32. | Corner of room. | 150. | Amplifier. |
| 34. | Opposite wall. | 156 & 158. | Reference threshold. |
| 36. | Floor plane. | | |
| 38. | Lower zone. | 250. | Amplifier. |
| 40. | Upper zone. | 256 & 258. | Reference threshold. |
| 42 & 44. | Pyroelectric elements. | 400. | Microwave detector. |
| 45. | Sensor output signal. | 404. | Transmitting antenna. |
| 46. | Pulse. | 406. | Receiving antenna. |
| 48. | Pulse. | 422. | Transceiver-detector. |
| 50. | Amplifier. | 424. | Sample and hold circuit. |
| 52 & 54. | Differential amplifiers. | 426 & 428. | Amplifiers. |
| 56 & 58. | Reference voltage conductors. | 430. | Voltage divider. |

We claim:

1. An infra-red intruder detector for covering a protected region above a floor plane and triggering an alarm signal in response to detected target temperatures different from background temperature; said detector comprising:

optics defining a lower field-of-view intercepting said floor plane in said region and an upper field-of-view extending entirely above said floor plane in said region; and, a control triggering said alarm signal at said target to background temperature differences: a) greater that seven degrees Fahrenheit in said lower field-of-view and b) less than seven degrees Fahrenheit in said upper field-of-view.

2. The invention of claim 1, wherein said control triggers said alarm signal at said respective target to background temperature differences: a) within a range of eight to thirteen degrees Fahrenheit in said lower field-of-view and b) within a range of one to four degrees Fahrenheit in said upper field-of-view.

3. An infra-red intruder detector for covering a protected region above a floor plane; said detector comprising:

infra-red sensing means defining a plurality of lower fields-of-view intercepting said floor plane in said region and a plurality of upper fields-of-view extending entirely above said floor plane in said region, said detector having a lower sensitivity to temperature change in said lower fields-of-view compared to said upper fields-of-view; and, control means coupled to said sensing means for detecting infra-red signals from humans in said lower fields-of-view and rejecting infra-red signals from dogs in said lower fields-of-view.

4. A passive infra-red intruder detector for issuing an alarm signal in response to temperature differentials between a background and a moving target; said detector comprising:

a sensing element sensitive to infra-red energy;

optics focusing infra-red energy onto said sensing element from discrete upper and lower fields-of-view, respectively, said detector having relatively greater sensitivity to said temperature differentials in said upper fields-of-view compared to said lower fields-of-view; and, temperature compensating means for changing said temperature sensitivity as a function of said background temperature in said lower fields-of-view, increasing said sensitivity as said background temperature approaches human skin temperature.

5. The invention of claim 4, wherein said temperature compensating means maintains said temperature sensitivity in said lower field-of-view at least three degrees less than said temperature sensitivity in said upper fields-of-view.

6. A passive infra-red intruder detector comprising:

a sensing element sensitive to infra-red energy;

infra-red optics defining multiple zones in a region under surveillance and focusing infra-red energy from said zones onto said sensing element, said zones including upper zones and lower zones, and wherein said optics is relatively more efficient transmitting infra-red energy from said upper zones compared to said lower zones.

7. A security device for detecting intruders in a region under surveillance, the region defined by an effective range of the device above a floor plane; said device comprising:

a pyroelectric sensor;

means defining at least one lower zone intercepting said floor plane within said region and at least one upper zone extending entirely above said floor plane in said region, said means directing infra-red energy from said upper zone onto said sensor with a first efficiency and from said lower zone onto said sensor with a second efficiency less than said first efficiency.

8. The invention of claim 7, wherein said means comprises a first group of lenslets defining said upper zone and a second group of lenslets defining said lower zone, and wherein said lenslets in said upper group have f-numbers lower than said lenses in said lower group.

9. The invention of claim 7, wherein said means includes a filter mechanism causing said pyroelectric sensor to be less responsive to infra-red energy from said lower zone compared to said upper zone.

10. The invention of claim 9, wherein said filter mechanism includes optical densities that are greater in said lower zone compared to said upper zone.

11. The invention of claim 7, further including:

a reference source providing a threshold signal establishing detection sensitivity of said device;

a temperature sensor providing an output signal proportional to temperature adjacent said sensor; and, an adjusting mechanism setting said threshold signal as a function of temperature to adjust the detection sensitivity of said device.

12. A security device for detecting intruders in a region defined by an effective range of the device above a floor plane; said device comprising:

first and second channels producing electrical signals in response to changes in infra-red energy in said region, said first channel defining lower zones intercepting said floor plane within said region and said second channel defining upper zones extending entirely above said floor plane in said region, said first channel being less sensitive to changes in infra-red energy than said second channel.

13. The invention of claim 12, wherein said second channel is twice as sensitive to changes in infra-red energy than said first channel.

14. The invention of claim 13, wherein said first and second channels respectively include means providing gain, and said gain in said second channel is greater than said gain in said first channel.

15. The invention of claim 12, wherein said device includes a filtering mechanism that attenuates the signal in said first channel compared to said second channel.

16. The invention of claim 12, wherein said first and second channels respectively include optical elements transmitting infra-red energy less efficiently in said first channel than in said second channel.

17. An infra-red intruder detector for covering a protected region having a background temperature and a floor plane; said detector comprising:

an infra-red sensing mechanism defining a lower field-of-view intercepting the floor plane and an upper field-of-view extending entirely above the floor plane;

a sensitivity adjusting mechanism maintaining said upper field-of-view more sensitive to temperature differentials than said lower field-of-view, within a predetermined range, over a wide range of background temperatures.

18. The invention of claim 17, wherein said predetermined range is between two degrees Fahrenheit and seven degrees Fahrenheit.

19. An infra-red intruder detector for covering a protected region having a background temperature and a floor plane; said detector comprising:

at least one pyroelectric sensing element producing electrical signals proportional to temperature differentials between a target in said region and the background temperature of said region;

optics defining a lower field-of-view intercepting the floor plane and an upper field-of-view extending entirely above the floor plane, said optics focusing infra-red energy onto said at least one sensing element from said upper and lower fields-of-view;

means for establishing different sensitivities to temperature differentials between the target and the background, said means maintaining said sensitivity in said upper field of view relatively greater than said sensitivity in said lower field-of-view; and, a temperature sensitivity control adjusting the respective temperature sensitivities in said upper and lower fields-of-view as a function of said background temperature, increasing said respective sensitivities as said background temperature approaches human skin temperature.

20. The invention of claim 19, wherein said detector sensitivity at a background temperature of seventy degrees Fahrenheit is less than seven degrees Fahrenheit in said lower field-of-view and greater than three degrees Fahrenheit in said upper field-of-view.

21. An intruder detector including an infra-red detector and a microwave detector covering the same protected area above a floor plane; said infra-red detector comprising:

infra-red sensing means defining a plurality of lower fields-of-view intercepting said floor plane in said region and a plurality of upper fields-of-view extending entirely above said floor plane in said region, said detector having a lower sensitivity to temperature change in said lower fields-of-view compared to said upper fields-of-view; and, sensitivity means coupled to said sensing means for detecting infra-red signals from humans in said lower fields-of-view and rejecting infra-red signals from dogs in said lower fields-of-view.

* * * * *